US006810869B2

(12) United States Patent
Gokan et al.

(10) Patent No.: US 6,810,869 B2
(45) Date of Patent: Nov. 2, 2004

(54) IGNITION DEVICE FOR PERSONAL WATERCRAFT ENGINE

(75) Inventors: Yoshitsugu Gokan, Saitama (JP); Toru Hasegawa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 190 days.

(21) Appl. No.: 10/188,070

(22) Filed: Jul. 3, 2002

(65) Prior Publication Data

US 2003/0010329 A1 Jan. 16, 2003

(30) Foreign Application Priority Data

Jul. 13, 2001 (JP) ..... 2001-213497

(51) Int. Cl.[7] ..... F02P 3/02; B63B 35/73

(52) U.S. Cl. ..... 123/635; 123/143 C; 123/169 PA; 336/96; 440/88 R

(58) Field of Search ..... 123/143 C, 169 PA, 123/634, 635, 647; 336/96; 440/88 R

(56) References Cited

U.S. PATENT DOCUMENTS 5,003,958 A * 4/1991 Yoneyama et al. ..... 123/635
6,250,980 B1 * 6/2001 Ozawa ..... 440/88 R
6,591,819 B2 * 7/2003 Tscherne et al. ..... 123/572

* cited by examiner

*Primary Examiner*—Tony M. Argenbright
(74) *Attorney, Agent, or Firm*—Birch, Stewart, Kolasch & Birch, LLP

(57) ABSTRACT

An ignition device for a personal watercraft engine, which allows mounting of a four-cycle engine on the personal watercraft and prevents occurrence of leakage of current. The engine for driving a jet propelling pump is provided in a watercraft body surrounded by a hull and a deck. A spark plug for spark ignition is provided in a cylinder head of the engine, and an integral cap ignition coil having a water-proof structure is water-tightly provided in the cylinder head in such a manner as to be located on the spark plug at an uppermost portion of the engine. A water-escape groove continuous to a recess for receiving a cap is formed in an upper surface of the cylinder head. A bottom surface of the escape groove is formed into a shape tilted downwardly.

18 Claims, 7 Drawing Sheets

IGNITION DEVICE FOR PERSONAL WATERCRAFT ENGINE

CROSS-REFERENCE TO RELATED APPLICATION

The present application claims priority under 35 U.S.C. §119 to Japanese Patent Application No. 2001-213497, filed Jul. 13, 2001, the entire contents of which are hereby incorporated by reference.

BACKGROUND OF THE INVENTION

1. Field of the Invention

The present invention relates to an ignition device for a personal watercraft engine.

2. Description of Background Art

Small two-cycle engines are commonly used for personal watercraft. Typically, the ignition is disposed in a sufficient space above a cylinder head of the engine. In prior art devices, ignition current is supplied via a high-tension cord from an ignition coil disposed on a side of the watercraft body to a spark plug in a cylinder head of the engine. However, since high-tension current flows from the ignition coil to the spark plug, if water droplets adhere on a surface in the vicinity of either, current leakage may occur, and current may escape via the water droplets. Accordingly, special measures are required to prevent current leakage, for example, waterproofing high-voltage areas and arranging and waterproofing the ignition coil.

In recent years, there has been a growing demand for four-cycle personal watercraft engines to reduce environmental damage caused by exhaust gas and noise pollution. However, a disadvantage associated with four-cycle personal watercraft engines is that a four-cycle engine is substantially higher than its two-cycle counterpart with the same displacement. As a result, if a four-cycle engine is mounted in the narrow body of a personal watercraft, much less space is available above the engine than if a two-cycle engine is mounted. Clearly, it is difficult to lay a high-tension cord and the like in such a cramped space.

SUMMARY AND OBJECTS OF THE INVENTION

It is an object of the present invention is to provide an ignition device for a personal watercraft engine which allows for the mounting of a four-cycle engine and which prevents current leakage.

To achieve these objects, a personal watercraft engine ignition device is provided which includes an engine for driving a jet propelling pump disposed in the watercraft body, which body is surrounded by a hull and deck. A spark plug for spark ignition is located in a cylinder head of the engine. An ignition coil having an integral cap is provided on the spark plug, and is mounted in a watertight manner on the cylinder head, thus constituting a waterproof structure.

In one embodiment, the ignition coil is disposed on an uppermost portion of the engine at a position higher than an open opening of an intake duct for supplying air to the watercraft body.

Also included are a female case connector portion provided on the cap of the integral cap ignition coil and a recess for receiving the cap and a water-escape groove continuous to the recess formed in a upper surface of the cylinder head. The escape groove is formed so as to extend from the recess to an opening of the female case connector portion. A bottom surface of the escape groove is tilted downwardly from the recess to the opening of the female case connector portion of the cap.

As described above, the engine for driving the jet propelling pump is provided in the watercraft body surrounded by the hull and the deck, the spark plug for spark ignition is disposed in the engine cylinder head, and the integral cap ignition coil is located on the spark plug. As a result, no high voltage portion is exposed in the watercraft body.

Accordingly, even if the inside of the watercraft body gets wet, current leakage will not occur. Thus, it is possible to prevent misfiring due to current leakage and, hence, to prevent increased hydrocarbon emissions. Further, since it is not necessary to lay a high-tension cord in a space over the engine, it is possible to mount a four-cycle engine in the narrow body of a personal watercraft.

Because the integral cap ignition coil is watertightly mounted in the cylinder head, water does not enter the area around the spark plug. This makes it possible to prevent engine misfiring due to soaking by water.

In addition, the integral cap ignition coil has a waterproof structure. As a result, it is possible to prevent water from soaking the ignition coil. By keeping out water out, engine misfiring can be prevented.

Since the integral cap ignition coil is provided on an uppermost portion of the engine and located at the remotest position from the water, even if water enters the watercraft body, it is possible to more positively prevent engine misfiring due to leakage of current.

Further, the intake duct for supplying intake air in the watercraft body is provided in the watercraft body and the integral cap ignition coil is provided at a position higher than that of the opening of the intake duct formed in the watercraft body. As a result, less of the water which may be splashed into the watercraft body via the intake duct reaches the ignition coil, again preventing engine misfire due to current leakage.

As described earlier, the female case connector portion is provided on the cap of the integral cap ignition coil, the recess for receiving the cap and the water-escape groove continuous to the recess are formed in an upper surface of the cylinder head, and the escape groove is formed so as to extend from the recess to an opening of the female case connector portion. Further, a bottom surface of the escape groove is tilted downwardly from the recess to the opening of the female case connector portion of the cap. As a result of this configuration, even if water splashes around the integral cap ignition coil onto the upper portion of the engine, the water can be readily discharged via the escape groove.

Since the escape groove tilts downwardly from the recess to the opening of the female case connector portion of the cap, when water is discharged, the water is not directed toward the opening of the connector portion. This feature further contributes to preventing engine misfire due to current leakage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment of the present invention will be described with reference to the drawings.

Figure 1:
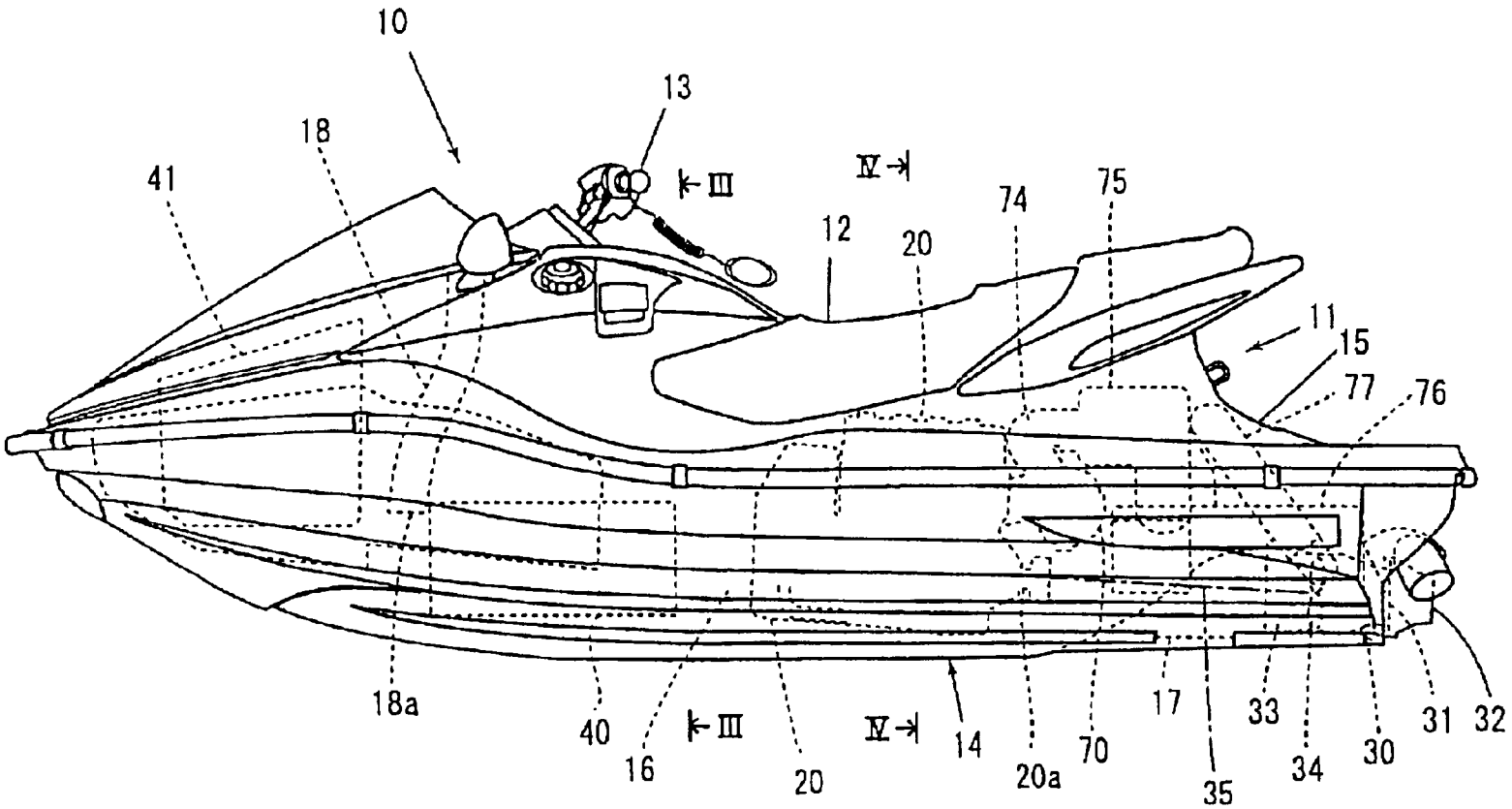
FIG. 1 is a schematic sectional view showing one example of a personal watercraft to which one embodiment of an ignition device for a personal watercraft engine according to the present invention is applied.

Referring to the drawings, and to FIG. 1 in particular, a personal watercraft 10 is a saddle-type small watercraft, which is operable by a driver who sits on a seat 12 provided on a watercraft body 11 and holds a steering handlebar 13 provided with a throttle lever.

The watercraft body 11 has a floating structure such that a hull 14 is joined to a deck 15 so as to form a space 16 therein. In space 16, an engine 20 is mounted on the hull 14. A jet pump or jet propelling pump 30, functioning as propelling means to be driven by the engine 20, is provided on a rear portion of the hull 14.

An intake duct 18 for supplying intake air in the watercraft body 11 (space 16) is provided on the watercraft body 11.

The jet pump 30 has a flow passage 33 extending from a water inlet 17 opened in a bottom of the hull 14 to both a jet port 31 opened in a rear end portion of the hull 14 and a nozzle 32, and an impeller 34 disposed in the flow passage 33. A shaft 35 of the impeller 34 is connected to an output shaft 20*a* of the engine 20. When the impeller 34 is rotated by the engine 20, water taken in via the water inlet 17 is jetted from the jet port 31 via the nozzle 32, thus propelling the watercraft body 11 forward. A rotational speed of the engine 20, that is, a propelling force of the jet pump 30 is controlled by a turning operation of a throttle lever 13*a* (see FIG. 2) of the steering handlebar 13. The nozzle 32 is coupled to the steering handlebar 14 via a steering wire (not shown), and is turned by operation of the steering handlebar 13, to change a running course.

Figure 2:
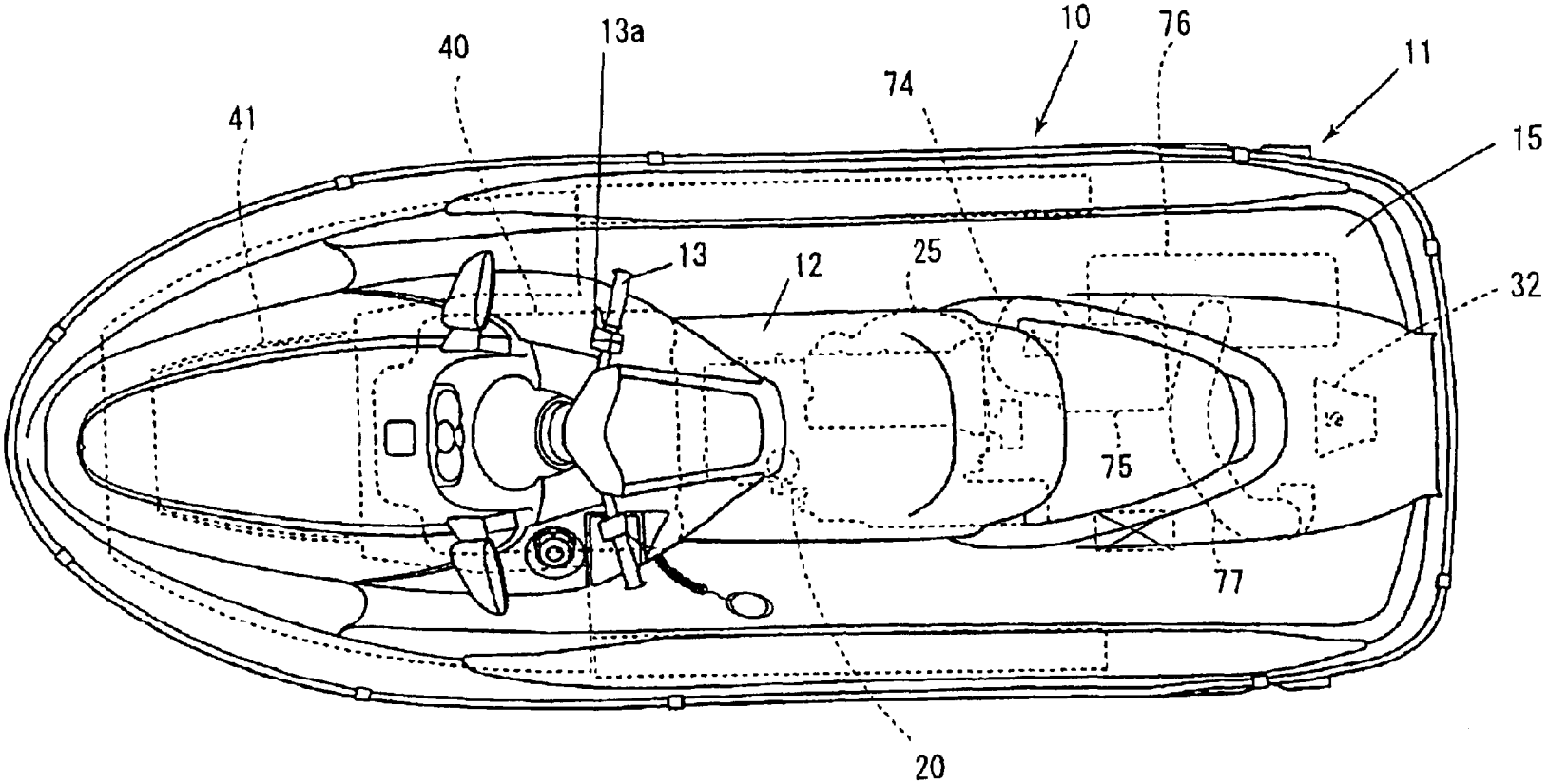
FIG. 2 is a plan view of the personal watercraft shown in FIG. 1.
Figure 3:
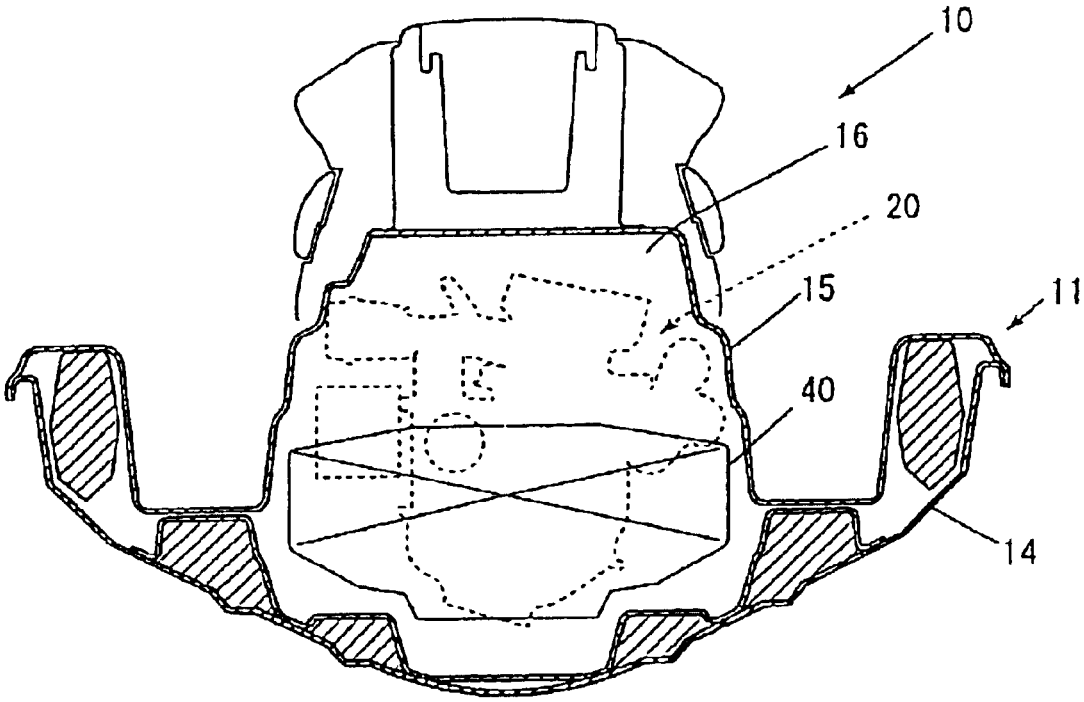
FIG. 3 is a partial, enlarged sectional view taken along line III—III of FIG. 1 (with parts partially omitted)

FIGS. 1–3 also show a fuel tank 40 and a storing chamber 41.

The engine 20 is a DOHC type in-line four-cylinder/four-cycle engine, wherein as shown in FIG. 1, a crankshaft (see output shaft 20*a*) of the engine 20 extends along the longitudinal direction of the watercraft body 11.

Figure 4:
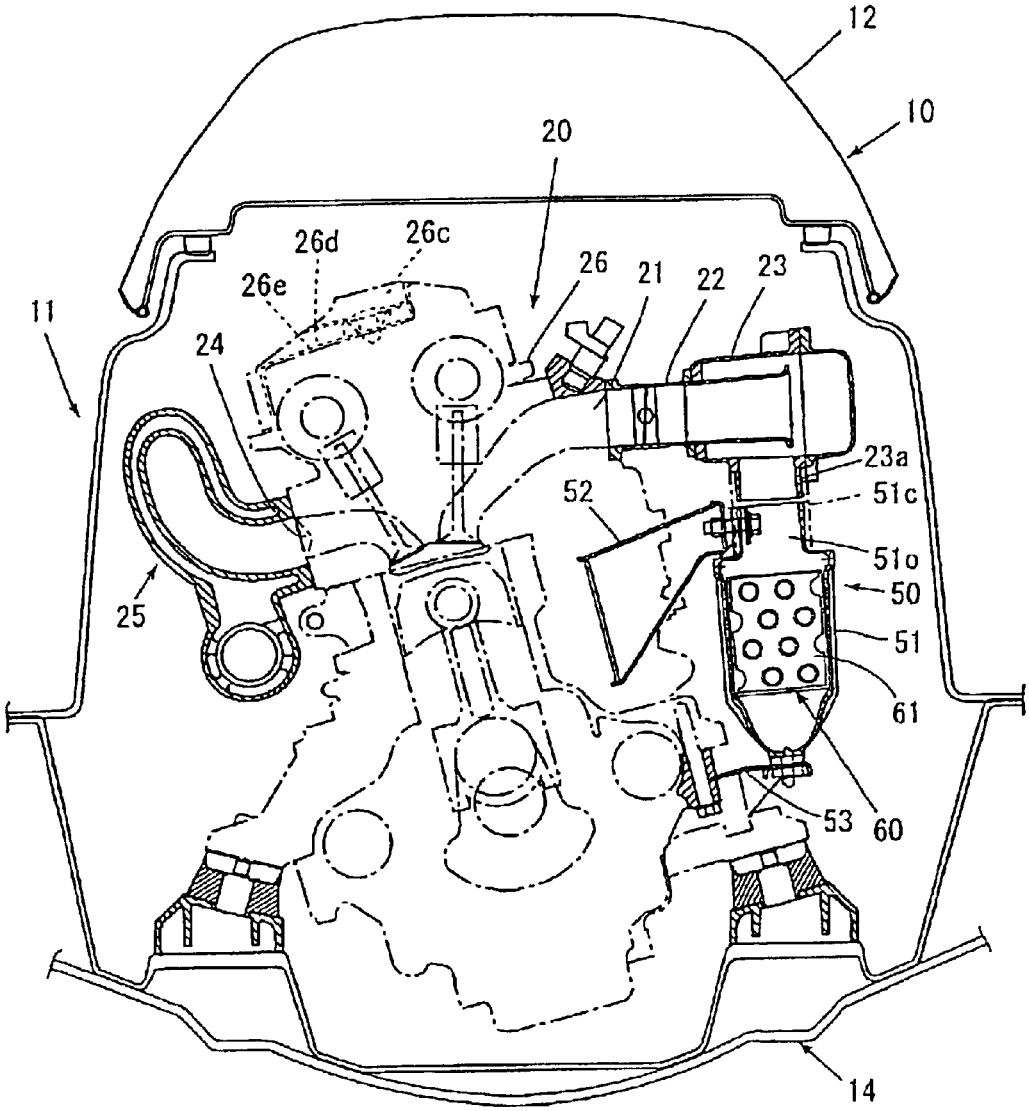
FIG. 4 is a partial, enlarged sectional view mainly showing the engine 20 taken on line IV—IV of FIG. 1 (with parts partially omitted)

Referring to FIG. 4, an intake port 21 is disposed on a left side of the engine 20 in the running direction of the watercraft 11. Further, and exhaust port 24 is disposed on a right side of the engine 20 in the running direction of the watercraft 11.

The intake duct 22 and a surge tank (intake chamber) 23 are connected to the intake port 21. An intercooler 50 disposed immediately under the surge tank 23 is connected to the surge tank 23. FIG. 4 also shows mounting brackets 52 and 53 of the intercooler 50, to be mounted to the engine 20.

Figure 5:
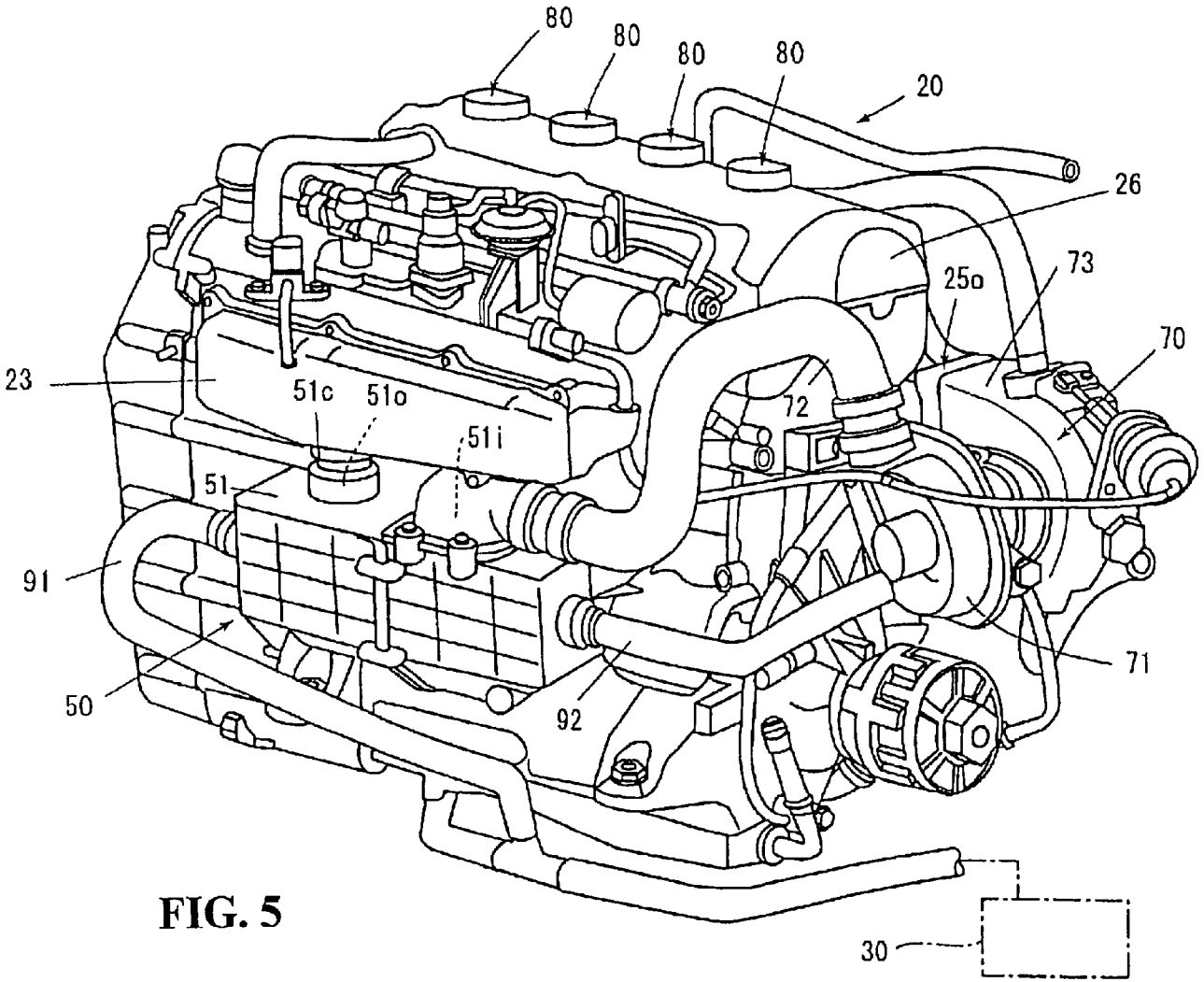
FIG. 5 is a schematic perspective view of the engine 20 as seen from an obliquely rearward direction.

As shown in FIGS. 4 and 5, the intercooler 50 includes a case 51 having an intake inlet 51*i* and an outlet 51*o*, and a cooling unit 60. The intake inlet 51*i* is connected and communicated, via piping 72, to a compressor portion 71 of a supercharger (turbo-charger) 70 disposed immediately behind the engine 20, and the outlet 51*o* is connected, via a tube 51*c*, to an intake inlet 23*a* of the surge tank 23. The cooling unit 60 is a heat exchange unit accommodated in the case 51 (see FIG. 4).

FIG. 5 shows cooling water hoses 91 and 92 connected to the intercooler 50.

Referring to FIG. 4, an exhaust manifold 25 is connected to the exhaust port 24 of the engine 20. Also, an exhaust outlet 25*o* (see FIG. 5) of the exhaust manifold 25 is connected to a turbine portion 73 of the turbo-charger 70.

As shown is FIGS. 1 and 2, exhaust gas, which has been used for rotating a turbine in the turbine portion 73, is discharged in water stream generated by the jet pump 30 via an exhaust pipe 74, an anti-counterflow chamber 75, a water muffler 76, and an exhaust/drainage pipe 77. The anti-counterflow chamber 75 is designed to prevent the counter-flow of water in cases when the watercraft turns-over.

Figure 6:
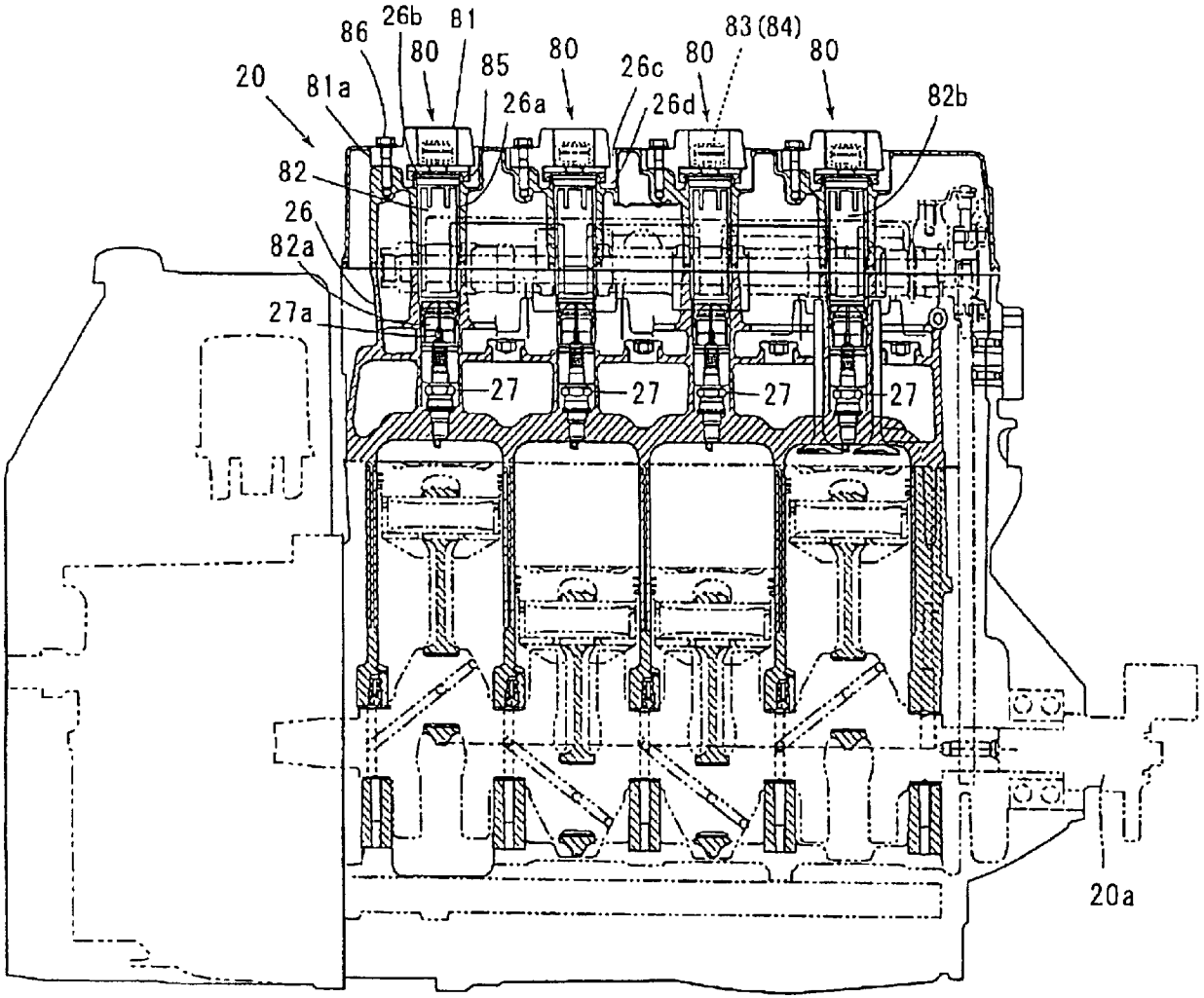
FIG. 6 is a partial, perspective side view of the engine 20.

FIG. 6 shows a spark plug 27 for spark ignition provided in each cylinder head 26 of the engine 20, and an integral cap ignition coil 80 provided on the spark plug 27.

The integral cap ignition coil 80 includes a cap 81 and an ignition coil portion 82 integrated with the cap 81. The ignition coil portion 82 is electrically connected to the spark plug 27 by inserting the ignition coil portion 82 in a hole 26*a* of the cylinder head 26 and connecting a lower portion 82*a* of the ignition coil portion 82 to a head portion 27*a* of the spark plug 27.

A switching circuit for operating the ignition coil portion 82 is contained in the cap 81.

Figure 7:
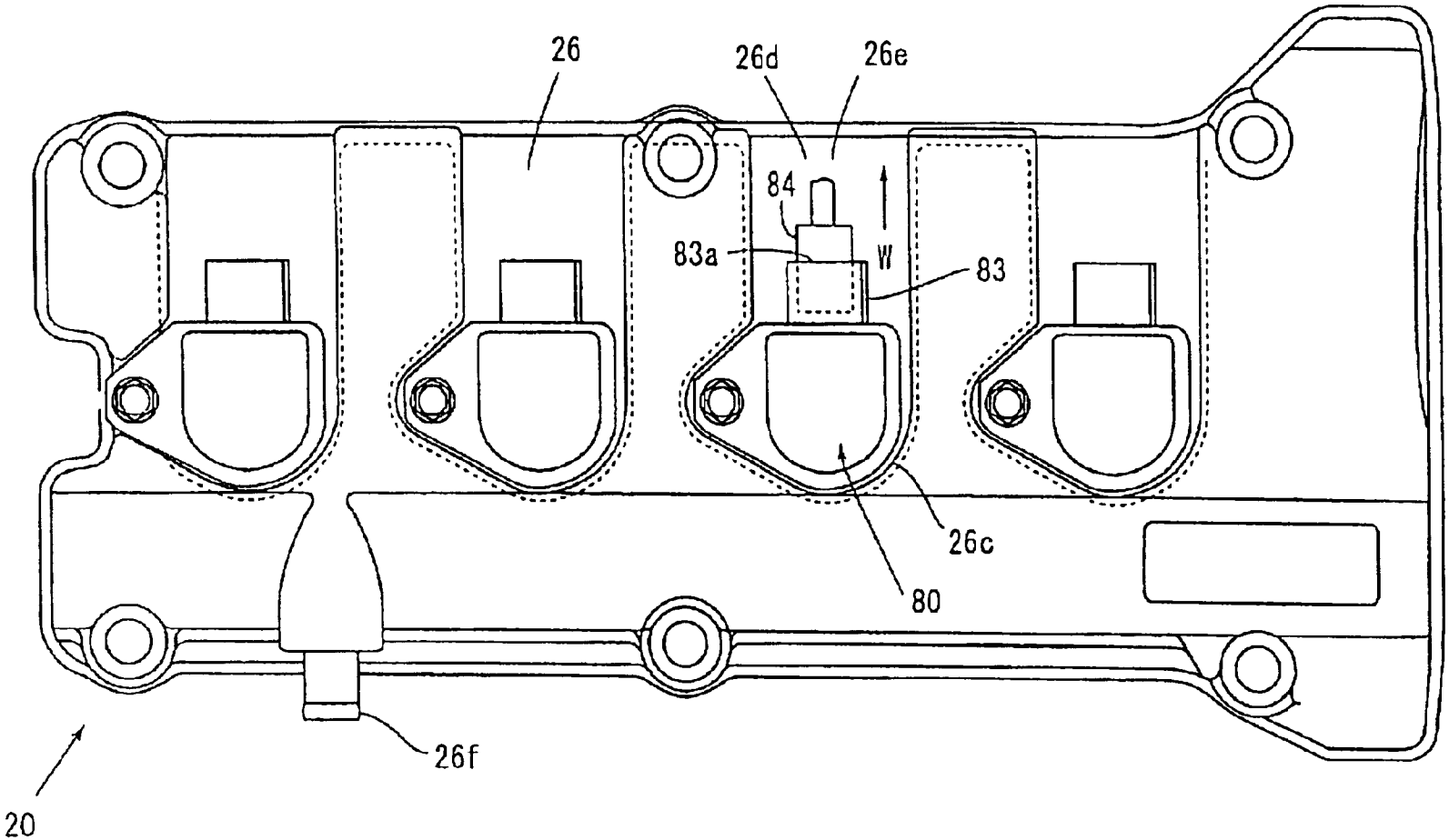
FIG. 7 is a plan view of the engine 20, equivalent to the front view of FIG. 6, showing a cylinder head and a cover thereof.

Referring to FIGS. 6 and 7, a connector portion 83 having a female case is formed on a right side surface of the cap 81. A connector 84 having a male case, which is connected to a control circuit (not shown), is inserted in the connector portion 83, to connect the switching circuit to the control circuit. In this case, any of a connector pin of the connector portion 83 and a connection pin of the connector 84 may be a male type pin.

With respect to the insertion hole 26*a* of the cylinder head 26, a water-proof ring 85 is interposed between and edge portion 26*b* of the insertion hole 26*a* and a lower portion of the cap 81, to prevent soak of water in the insertion hole 26*a*. Accordingly, the integral cap ignition coil 80 is water-tightly mounted to the cylinder head 26 of the engine 20.

The ignition coil portion 82 is contained in a cylindrical case 82*b*. Accordingly, the integral cap ignition coil 80 has a water-proof structure.

The integral cap ignition coil 80 configured as described above is mounted to the cylinder head 26 by initially mounting the water-proof ring 85 on an upper portion of the ignition coil portion 82 (immediately under the cap 81). Next, the ignition coil portion 82 is inserted into the hole 26*a* of the cylinder head 26, connecting the lower portion 82*a* of the ignition coil portion 82 to the head portion 27*a* of the spark plug 27 as described above. Lastly, a flange portion 81*a*, which is integrally formed on a side surface of the front portion of the cap 81, is fixed to the cylinder head 26 with a bolt 86.

As is apparent from FIGS. 4 to 7, the integral cap ignition coil 80 is provided on an uppermost portion of the engine 20. As is also apparent from FIG. 1, the integral cap ignition coil 80 is provided at position higher than that of an opening 18*a*, opened in the watercraft body, of the intake duct 18.

Referring to FIGS. 4, 6 and 7, a recess 26*c* for receiving the cap 81 is formed in an upper surface of the cylinder head 26, and a water-escape groove 26*d* continuous to the recess 26*c* is also formed in the upper surface of the cylinder head 26. As can be seen in FIG. 7, the escape groove 26*d* is formed in such a manner as to extend from the recess 26*c* to and opening 83*a* of the female case connector portion 83 of the cap 81. As shown in FIG. 4, a bottom surface 26*e* of the escape groove 26*d* (part of the upper surface of the cylinder head) is tilted downwardly (in the direction from the recess 26*c* to the opening 83*a* of the female case connector portion 83 of the cap 81).

FIG. 7 shows a breather pipe 26*f*.

As summarized below, the ignition device for a personal watercraft engine configured in the present invention affords numerous effects and benefits:

(a) Since the engine 20 for driving the jet propelling pump 30 is provided in the watercraft body 11 surrounded by the hull 14 and the deck 15, and spark plug 27 for spark ignition is provided in the cylinder head 26 of the engine 20 and integral cap ignition coil 80 is provided on the spark plug 27, a high voltage portion is not exposed in the watercraft body 11.

Accordingly, even if the inside of the watercraft body 11 becomes wet, leakage of current is prevented. As a result, it is possible to prevent misfire due to leakage of current, and hence to prevent an increased amount of hydrocarbon in the exhaust.

Further, since there is no requirement to lay a high-tension cord in a space over the engine 20, it is possible to mount a four-cycle engine in the narrow watercraft 11 of a personal watercraft.

(b) Since the integral cap ignition coil 80 is water-tightly mounted in the cylinder head 26 of the engine 20, water does not enter the area of the spark plug 27.

Accordingly, it is possible to prevent misfiring of the engine due to soaking by water.

(c) Since the integral cap ignition coil 80 has a water-proof structure, it is possible to prevent the ignition coil 80 form getting soaked by water.

(d) Since the integral cap ignition coil 80 is provided on an uppermost portion of the engine 20, even if water enters the watercraft body 11, the integral cap ignition coil 80 is located at the remotest position from the water.

Accordingly, it is possible to more positively prevent engine misfiring due to leakage of current.

(e) Since the intake duct 18 for supplying intake air in the watercraft body 11 is provided in the watercraft body 11 and the integral cap ignition coil 80 is provided at a position higher than that of the opening 18*a* of the intake duct 18, less of the water which may have entered the watercraft body 11 via the intake duct 18 is likely to reach the ignition coil 80.

Accordingly, it is possible to more certainly prevent engine misfiring due to leakage of current.

(f) Since the water-escape groove 26*d* continuous to the recess 26*c* is formed in an upper surface of the cylinder head 26, and the escape groove 26*d* extends from the recess 26*c* to an opening 83*a* of the female case connector portion 83 of the cap 81, and a bottom surface 26*e* of the escape groove 26*d* is tilted downwardly in the direction from the recess 26*c* to the opening 83*a* of the female case connector portion 83 of the cap 81, even if water is splashed around the integral cap ignition coil 80, the water can be readily discharged from via the escape groove 26*d*. This can be clearly seen by an arrow W in FIG. 7.

Since the escape groove 26*d* is formed tilting downwardly in the direction from the recess 26*c* to the opening 83*a* of the female case connector portion 83 of the cap 81, when water is discharged (in the direction of arrow W), it is directed away from the opening 83*a* of the connector portion 83.

Accordingly, it is possible to more positively prevent engine misfiring due to leakage of current.

The invention being thus described, it will be obvious that the same may be varied in may ways. Such variations are not to be regarded as a departure from the spirit and scope of the invention, and all such modification as would be obvious to one skilled in the art are intended to be included within the scope of the following claims.

What is claimed is:

1. An ignition device of an engine for a personal watercraft, comprising:

an engine for driving a jet propelling pump is provided in a watercraft body surrounded by a hull and a deck;

a spark plug for spark ignition is provided in a cylinder head of said engine; and a ignition coil with integral cap is provided on said spark plug;

a recess for receiving said cap; and a water escape groove continuous to said recess formed in an upper surface of said cylinder head.

2. The ignition device of an engine for a personal watercraft according to claim 1, wherein said ignition coil with integral cap is water-tightly mounted in said cylinder head of said engine.

3. The ignition device of an engine for a personal watercraft according to claim 1, wherein said ignition coil with integral cap has a water-proof structure.

4. The ignition device of an engine for a personal watercraft according to claim 3, further comprising a water-proof ring interposed between an edge portion of an insertion hole in said cylinder head and a lower portion of a cap to prevent water from entering said insertion hole.

5. The ignition device of an engine for a personal watercraft according to claim 3, further comprising a flange portion on said cap and a bolt for fixing said flange portion to said cylinder head.

6. The ignition device of an engine for a personal watercraft according to claim 1, wherein said ignition coil with integral cap is provided on an uppermost portion of said engine.

7. The ignition device of an engine for a personal watercraft according to claim 1, wherein an intake duct for supplying intake air in said watercraft body is provided in said watercraft body, and said ignition coil with integral cap is provided at a position higher than that of an opening, opened in said watercraft body, of said intake duct.

8. The ignition device of an engine for a personal watercraft according to claim 1, further comprising:

a female case shaped connector portion provided on a cap of said ignition coil with integral cap, wherein said escape groove is formed in said recess in such a manner as to extend from said recess to an opening of said female case shaped connector portion, and a bottom surface of said escape groove being tilted downwardly in the direction from said recess to the opening of said female case shaped connector portion of said cap.

9. The ignition device of an engine for a personal watercraft according to claim 8, wherein said female case shaped connector portion tilts downwardly from said cap, and extends over said bottom surface of said escape groove and in a direction toward an exhaust manifold of said engine.

10. An ignition device of an engine for a personal watercraft, comprising:

an engine for driving a jet propelling pump is provided in a watercraft body surrounded by a hull and a deck;

a spark plug for spark ignition is provided in a cylinder head of said engine;

a ignition coil with integral cap is provided on said spark plug; and a female case shaped connector portion provided on said integral cap of said ignition coil with integral cap, wherein said female case shaped connector portion tilts downwardly from said cap, and extends over a bottom surface of an water escape groove formed in a recess of the cylinder head.

11. The ignition device of an engine for a personal watercraft according to claim 10, wherein said ignition coil with integral cap is water-tightly mounted in said cylinder head of said engine.

12. The ignition device of an engine for a personal watercraft according to claim 10, wherein said ignition coil with integral cap has a water-proof structure.

13. The ignition device of an engine for a personal watercraft according to claim 12, further comprising a water-proof ring interposed between an edge portion of an insertion hole in said cylinder head and a lower portion of a cap to prevent water from entering said insertion hole.

14. The ignition device of an engine for a personal watercraft according to claim 12, further comprising a flange portion on said cap and a bolt for fixing said flange portion to said cylinder head.

15. The ignition device of an engine for a personal watercraft according to claim 10, wherein said ignition coil with integral cap is provided on an uppermost portion of said engine.

16. The ignition device of an engine for a personal watercraft according to claim 10, wherein an intake duct for supplying intake air in said watercraft body is provided in said watercraft body, and said ignition coil with integral cap is provided at a position higher than that of an opening, opened in said watercraft body, of said intake duct.

17. The ignition device of an engine for a personal watercraft according to claim 10, wherein said water escape groove is continuous to said recess formed in an upper surface of said cylinder head, said escape groove being is formed in such a manner as to extend from said recess to an opening of said female case shaped connector portion, and a bottom surface of said escape groove being tilted downwardly in the direction from said recess to the opening of said female case shaped connector portion of said cap.

18. The ignition device of an engine for a personal watercraft according to claim 10, wherein said female case shaped connector portion extends tilted downwardly in a direction toward an exhaust manifold of said engine.

* * * * *